US005245907A

United States Patent [19]

Gyre

[11] Patent Number: 5,245,907

[45] Date of Patent: Sep. 21, 1993

[54] AUTOMATIC WEAPON MUNITION FEED DEVICE

[75] Inventor: Christian Gyre, St Germain les Vergnes, France

[73] Assignee: GIAT Industries, France

[21] Appl. No.: 698,194

[22] Filed: May 6, 1991

Related U.S. Application Data

[63] Continuation of Ser. No. 497,898, Mar. 23, 1990, abandoned.

[51] Int. Cl.[5] ..... F41A 9/04

[52] U.S. Cl. ..... 89/34; 89/33.1; 89/33.17; 193/25 AC

[58] Field of Search ..... 89/34, 35.01, 33.14, 89/32.16, 33.17, 33.1, 33.05, 33.02, 45, 33.01; 198/25 AC

[56] References Cited

U.S. PATENT DOCUMENTS

| | | | |
|---|---|---|---|
| 2,380,773 | 7/1945 | McMullen | 89/33.01 |
| 2,473,716 | 6/1949 | Lewis et al. | 193/25 AC |
| 2,740,180 | 4/1956 | Nobles | 89/33.14 |
| 2,951,422 | 9/1960 | Bobkowski | 89/33.14 |
| 4,416,184 | 11/1983 | Jenny | 193/25 AC |
| 4,669,355 | 6/1987 | Schmid et al. | 89/33.1 |

FOREIGN PATENT DOCUMENTS

| | | | |
|---|---|---|---|
| 779026 | 3/1935 | France | 193/25 AC |
| 1153602 | 3/1958 | France | 89/33.1 |
| 583410 | 6/1946 | United Kingdom | 89/33.14 |
| 590783 | 7/1947 | United Kingdom | 193/25 AC |

*Primary Examiner*—Stephen M. Johnson
*Attorney, Agent, or Firm*—Parkhurst, Wendel & Rossi

[57] ABSTRACT

An automatic munition device, mobile in translation between a weapon and a fixed feeder, having means to transfer the munition in a path defined by an arc of a circle between the fixed feeder and the weapon, the munition being moved parallel to the fixed feeder and perpendicular to the translation motion of the munition. The feed device has a variable-pitch helical ramp having the same center as the center of the arc, one end of the ramp being integral with the weapon and the other end integral with the fixed feeder. The ramp also has guiding means to position the munition axially during feeding of the munition.

6 Claims, 2 Drawing Sheets

AUTOMATIC WEAPON MUNITION FEED DEVICE

This ia a continuation of application Ser. No. 07/497,898 filed Mar. 23, 1990, now abandoned.

FIELD OF THE INVENTION

The present invention relates to a munition feed device for an automatic weapon, and more particularly for a weapon that is mobile in translation with respect to a fixed feeder, wherein the device includes known means for transferring the round along an arc of a circle between the feeder and the weapon, parallel to the weapon and perpendicular to its translational motion.

As of today, there exist no such devices to bring a round to a precise point in the weapon, regardless of the weapon position, whereby it may consequently be introduced into the breech without impact.

The goal of the present invention is to provide such a device.

SUMMARY OF THE INVENTION

The object of the invention is therefore a munition feed device for an automatic weapon that is mobile in translation with respect to a fixed feeder, including means for transferring the rounds in a circular arc between the feeder and the weapon, parallel to the weapon and perpendicular to its translational motion, wherein it includes a variable-pitch helical ramp having the same axis as the transfer arc, with one end integral with the weapon and the other with the feeder. The ramp has guiding means to position the round axially during its transfer.

The guiding means may include a groove arranged to operate with the case plate rim of the round.

In one preferred embodiment of the invention, the ramp is formed of a plurality of elements arranged to slide with respect to each other in parallel with the translational motion of the weapon.

In order to ensure the helical form of the ramp, each element may include at least one hole, a flexible wire, e.g. of the piano string type, passing through each of the holes, with the wire having one end mounted on the feeder and the other mounted on the weapon.

The sliding of the elements with respect to each other may be ensured by means of a rib formed on each element and arranged to cooperate with a groove in an adjacent element.

The circular arc shape of all of the elements may be obtained by providing each element with a contact surface with each of the adjacent elements, with the contact surface of each element forming a plane angle about an axis that is roughly identical to the axis of the round transfer arc.

As one of the ramp extremities is linked to the feeder, each time a round comes out of the feeder it engages in the helical ramp, which then guides it longitudinally during its transfer to the weapon, with which the other end of the ramp is integral.

This guiding can, it particular, be provided by a groove in which the round case plate rim fits, so that the round moves axially simultaneously with its transverse circular transfer motion. At the final end of the ramp, the round is therefore in the desired position with respect to the weapon, which then takes it over.

BRIEF DESCRIPTION OF THE DRAWINGS

We will now described one particular embodiment, as a nonlimitative example of the invention, in reference to the accompanying drawing in which.

Detailed Description of the Drawings

Figure 1:
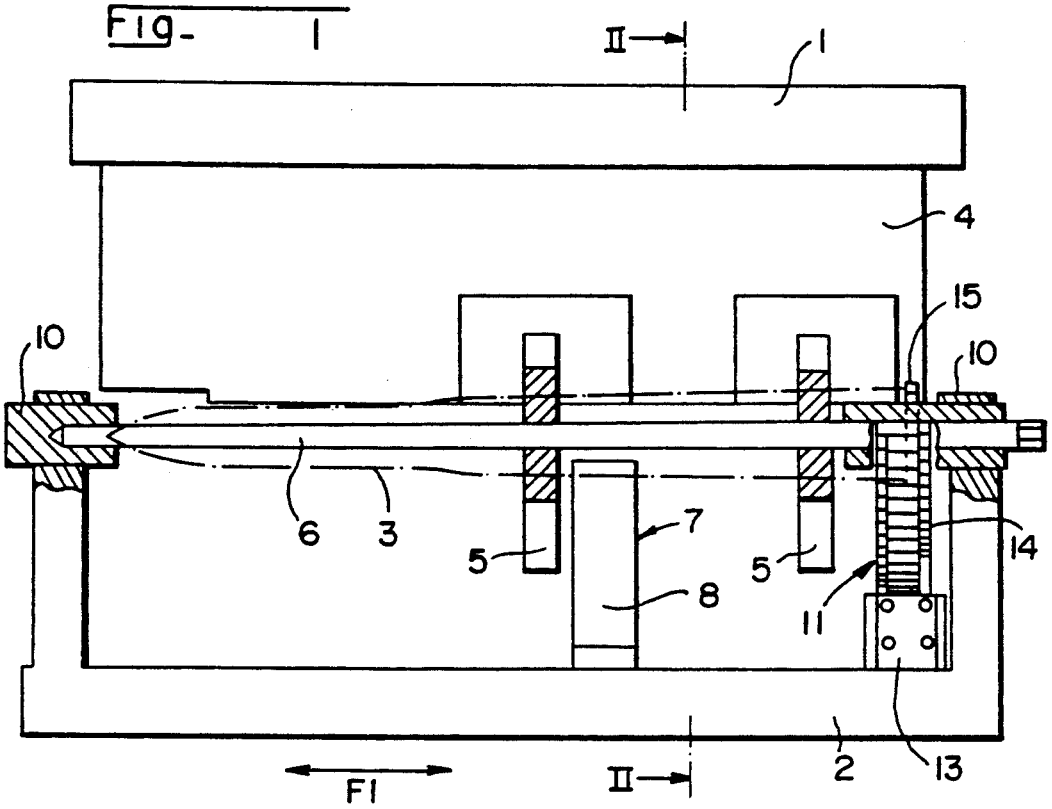
FIG. 1 is an overall elevation view of a device according to the invention with the feeder and the weapon in relative median position.
Figure 2:
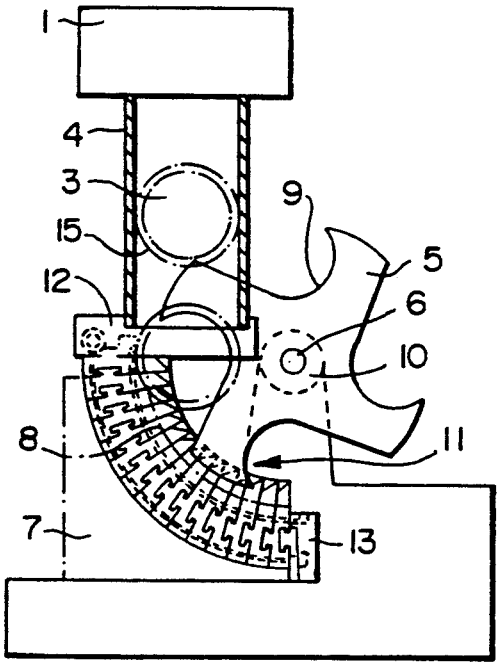
FIG. 2 is a view of the section along the line II—II of FIG. 1.
Figure 5:
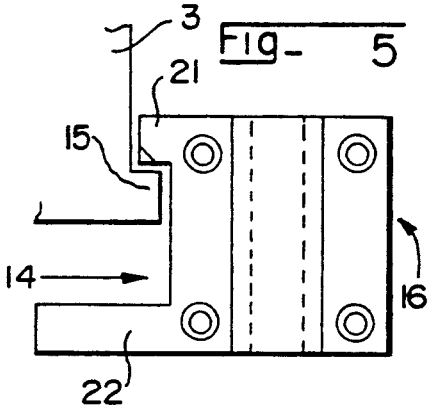
FIG. 5 is a top view of one ramp element according to the invention.
Figure 6:
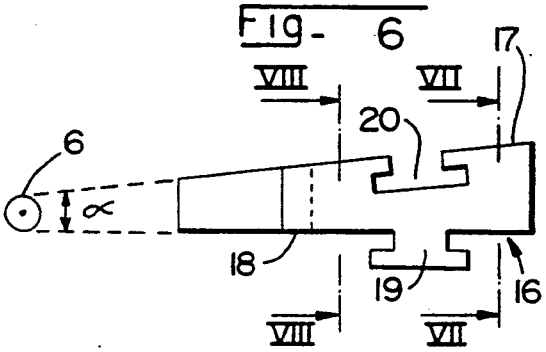
FIG. 6 is an elevation view of the element of FIG. 5.

FIGS. 1 to 4 represent the feeder 1 and weapon 2 schematically in blocks. The rounds 3 are transferred from the feeder to the weapon in a known fashion by means of a chute 4.

The feeding system consists of two star plates 5 mounted on a shaft 6 and a support ramp 7 whose upper surface 8 is a cylindrical surface centered about the shaft 6.

When the rounds 3 come out of the chute 4, they are driven by the surfaces 9 of the stars 5 along the surface 8 in such a way as to be brought up to the weapon 2 along a path of circular arch geometry, centered about the shaft 6.

The chute 4 is integral with the feeder 1 while the feed system, consisting of shaft 6, star plates 5 and support ramp 7, are integral with the weapon 2, considering that the shaft 6 is mounted in bearings 10 integral with the weapon.

The feeder 1 is fixed while the weapon 2 moves with respect to it in an alternating translational motion represented by the arrow F1 parallel to the shaft 6 and to the axes of the rounds 3.

The problem that is raised is therefore to bring the rounds to a precise point of the weapon 2 despite this motion.

This problem is solved by a variable-pitch helical guiding ramp 11. This ramp has its upper extremity mounted on a fitting 12 integral with the chute 4 of the feeder 1 and its lower end mounted on a fitting 13 integral with the weapon 2.

The ramp 11, seen in a projection perpendicular to the shaft 6, forms an arc of a circle centered about this shaft, and its concave surface forms a groove 14 in which the case plate rim 15 of the round is engaged during the round transfer.

Due to the deformable character of the ramp 11, the slower part follows the motion of the weapon 2, so that as the round 3 is being transferred through the circular arc, an axial motion is also imparted to it as the case plate rim 15 is held in the guiding groove 14.

The round 3 consequently arrives at the level of the weapon 2 in a precise axial position determined by the position of the fitting 13 on the weapon 2.

The ramp 11 therefore consists of a stack of elements 16 sliding with respect to each other in a direction parallel to the shaft 6.

Such an element is represented in FIGS. 5 to 8.

Each element 16 is roughly wedge-shaped, with the two convergent surfaces 17 and 18 forming the contact surfaces with the adjacent elements. The plane angle between these surfaces 17 and 18 and the number of elements 16 is such that the stack of elements 16 forms the desired circular arc shape of the ramp 11. When these elements are stacked, the edges of the plane angles 4 formed by the surfaces 17 and 18 are therefore identical with the shaft 6.

The elements 16 are assembled together and slide with respect to each other by means of ribs 19 which, in the present case, have a tee section and are formed on the face 18 of the element, and a groove 20 of corresponding shape on the opposite face 17.

Each rib 19 is fitted in the groove 20 of the adjacent element, except for the upper element, whose rib is engaged in a groove of the same shape in fitting 12, and the lower element, whose groove 20 receives a rib of the corresponding shape on the fitting 13.

Each element has, on the side of the above-mentioned plane angle edge, two lateral wxtensions 21 and 22 which, when the elements 16 are installed. therefore protrude in the direction of the shaft 6, the stacking of these extensions thereby forming the guiding groove 14 in which the case plate rim 15 of the round 3 is engaged.

Figure 3:
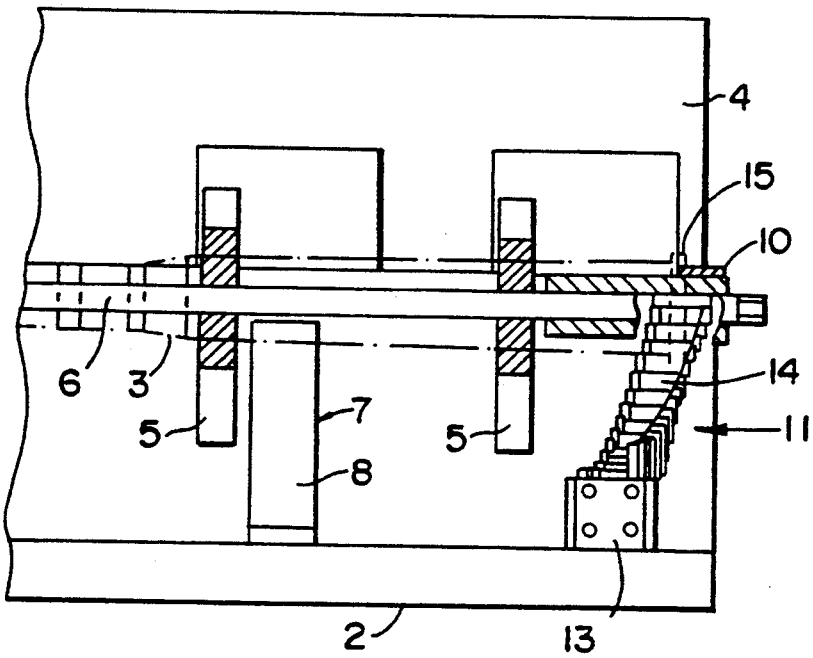
FIGS. 3 and 4 are views similar to FIG. 1 with the feeder and weapon in their relative extreme positions.
Figure 4:
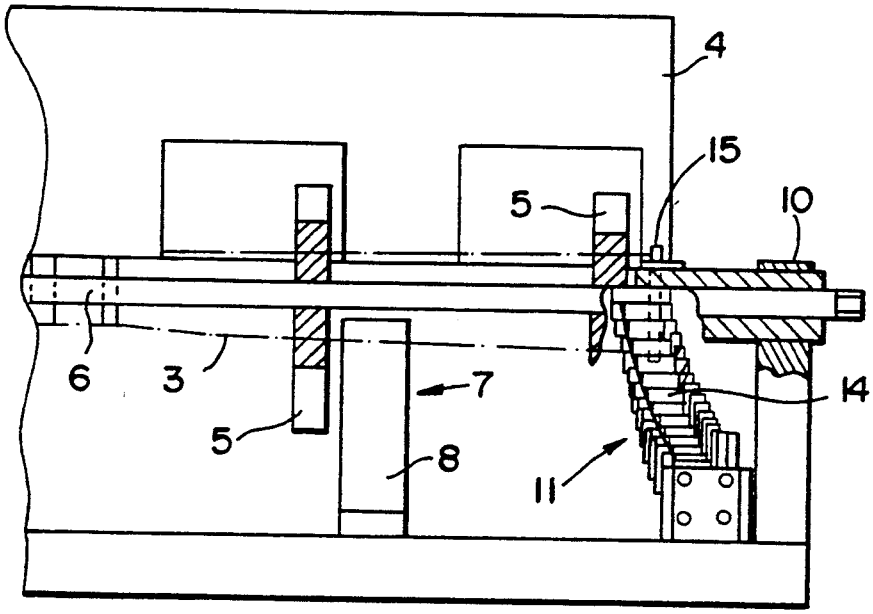
Figure 7:
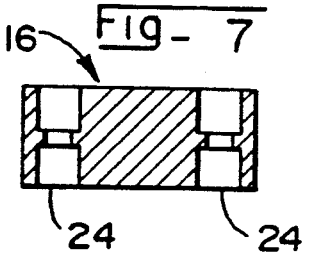
FIGS. 7 and 8 are view of the sections along lines VII—VII and VIII—VIII. respectively, of FIG. 6.
Figure 8:
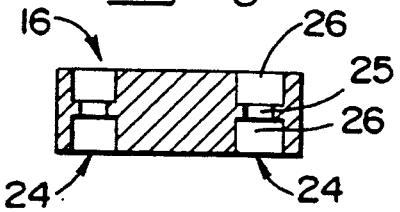

The width of the elements 16 is such that the extensions 21 and 22 have a separation that endows the rib 14 with sufficient width to avoid pinching the rim 15 in the extreme positions shown in FIGS. 3 and 4 of the weapon 2 with respect to the feeder 1.

In the case where the case plate rim 15 is lacking, the case plate can be engaged in a shuttle that has such a rim.

The helical shape of the ramp is provided by two piano string wires 23 engaged in the holes 24 rougly perpendiuclar to the faces 17 and 18 of the element 16. The holes 24 shown in cross section in FIGS. 7 and 8 have a narrow part 25 in their center, enlarged to either side by countersinks 26. The narrow part 25 allows the wire 23 to slide through, while the countersinks 26 allow torsional motions of the wire. The difference in diameter between the narrow part 25 and the wide part 26 controls the maximum torsion and thereby the pitch of the helix. The piano strings 23 have one end mounted in the fitting 12 and the other in the fitting 13.

When the ramp deforms, the length of string needed to hold the elements 16 lined to each other varies. The minimum length is equal to an arc of a circle, while the maximum length is equal to an arc of a cylindrical spiral. To allow this elongation, the attachment to the fittings 12 and 13 of each end of the string is a sliding one. The fact that a piano string is used, which has a certain elasticity, contributes to gradually braking the elements 16 of the ramp when they arrive at the end of their course of travel.

As the weapon 2 moves alternately with respect to the feeder 1 from one extreme position shown in FIG. 3 to the other extreme position shown in FIG. 4, the round 3 is taken over at the level of the fitting 12 and is then guided into the weapon, where it arrives at a precise position determined by the position of the fitting 13.

Any and all modifications or variations which may occur to those skilled in the art should be considered to be within the scope and spirit of the invention as defined in the appended claims.

What is claimed is:

1. A munition feeding device for an automatic weapon, said munition containing a case plate rim, said weapon being mobile in translation to a fixed feeder, said feeding device including means for transporting said munition along a path between said fixed feeder and said weapon, which said path is delimited by an arc of a circle when viewed in a direction parallel to the axis about which said munition rotates, said device including a ramp having one extremity which is integral with said weapon and another extremity which is integral with said fixed feeder, wherein said ramp has a variable configuration ranging from an arc to a helix depending on a position of said weapon with respect to the position of said fixed feeder, said ramp having guiding means to position said case plate rim of said munition axially during munition feeding from said fixed feeder to said weapon, wherein said ramp is formed of a plurality of elements arranged to slide, with respect to each other, along axes paralleling the translational motion of said weapon, and wherein each element of said plurality of elements includes at least one hole, with a flexible wire passing through each said hole and mounted at one end on said fixed feeder and at another end on said weapon.

2. The device of claim 1, wherein said guiding means includes a groove arranged to cooperate with said case plate rim.

3. The device of claim 1, wherein each element of said plurality of elements has one rib arranged to cooperate with a groove in an adjacent element of said plurality of elements.

4. The device of claim 3, wherein each element of said plurality of elements has two contact surfaces, each surface for contact with the adjacent element of said plurality of elements, the two contact surfaces of each element defining a plane angle whose apex roughly coincides with the center of said arc.

5. The device of claim 1, wherein said hole has a center portion and enlarged parts on either side thereof.

6. The device of claim 1, wherein said flexible wire is a piano string whose extremities are attached to said fixed feeder and to said weapon.

* * * * *